US007234530B2

(12) United States Patent
Gass

(10) Patent No.: US 7,234,530 B2
(45) Date of Patent: Jun. 26, 2007

(54) RAM BOP SHEAR DEVICE

(75) Inventor: Dustin Dean Gass, Houston, TX (US)

(73) Assignee: Hydril Company LP, Houston, TX (US)

( * ) Notice: Subject to any disclaimer, the term of this patent is extended or adjusted under 35 U.S.C. 154(b) by 299 days.

(21) Appl. No.: 10/979,090

(22) Filed: Nov. 1, 2004

(65) Prior Publication Data

US 2006/0090899 A1 May 4, 2006

(51) Int. Cl.
*E21B 19/00* (2006.01)

(52) U.S. Cl. ..... 166/376; 166/377; 166/85.4; 166/85.3

(58) Field of Classification Search ..... 166/376, 166/377, 54.3, 85.4, 87.1, 90.1, 55; 251/1.3
See application file for complete search history.

(56) References Cited

U.S. PATENT DOCUMENTS

| | | | |
|---|---|---|---|
| 3,273,855 | A | 9/1966 | Wells |
| 3,561,526 | A | 2/1971 | Williams, Jr. et al. |
| 3,817,326 | A | 6/1974 | Meynier, III |
| 4,043,389 | A | 8/1977 | Cobb |
| 4,081,027 | A | 3/1978 | Nguyen |
| 4,132,266 | A | 1/1979 | Randall |
| 4,132,267 | A | 1/1979 | Jones |
| 4,240,503 | A | 12/1980 | Holt, Jr. et al. |
| 4,313,496 | A | 2/1982 | Childs et al. |
| 4,323,117 | A | 4/1982 | Pierce |
| 4,341,264 | A | 7/1982 | Cox et al. |
| 4,347,898 | A | 9/1982 | Jones |
| 4,349,175 | A | 9/1982 | Akkerman et al. |
| 4,508,313 | A | 4/1985 | Jones |
| 4,523,639 | A | 6/1985 | Howard, Jr. |
| 4,537,250 | A | 8/1985 | Troxell, Jr. |
| 4,540,046 | A | 9/1985 | Granger et al. |
| 4,554,976 | A | 11/1985 | Hynes et al. |
| 4,580,626 | A | 4/1986 | Jones |
| 4,612,983 | A | 9/1986 | Karr, Jr. |
| 4,646,825 | A | 3/1987 | Van Winkle |
| 4,671,312 | A | 6/1987 | Bruton |
| 4,911,410 | A | 3/1990 | Baker |
| 4,997,162 | A | 3/1991 | Baker et al. |

(Continued)

OTHER PUBLICATIONS

PCT Notification of Transmittal of ISR & WO; International Search Report and Written Opinion issued in corresponding PCT Application No. PCT/US05/39519; Dated Jan. 3, 2007; 9 pages.

*Primary Examiner*—Jennifer H. Gay
*Assistant Examiner*—Brad Harcourt
(74) *Attorney, Agent, or Firm*—Osha Liang LLP

(57) ABSTRACT

A ram-type blowout preventer may include a body, a first ram block positioned within the body and having a first shearing element and a first sealing element, and a second ram block positioned within the body and opposing the first ram block, the second ram block having a second shearing element and a second sealing element. The blowout preventer may also include a load intensifying member coupled to the first ram block, wherein the first ram block and the second ram block are configured to close together upon activation of the blowout preventer, and wherein the load intensifying member is positioned to engage with the second ram block when the first and second ram block close and force the first shearing element and the second shearing element together.

13 Claims, 5 Drawing Sheets

U.S. PATENT DOCUMENTS 5,163,655 A 11/1992 Chickring, III et al.
5,360,061 A 11/1994 Womble
5,370,362 A 12/1994 Kent et al.
5,400,857 A 3/1995 Whitby et al.
5,501,424 A 3/1996 Williams et al.
5,515,916 A 5/1996 Haley
5,645,098 A 7/1997 Morrill
5,803,431 A 9/1998 Hoang et al.
6,173,770 B1 1/2001 Morrill
6,223,819 B1 5/2001 Heinonen
6,244,336 B1 6/2001 Kachich
6,454,015 B1 9/2002 Armstrong
6,455,015 B1 9/2002 Kilroy
6,554,247 B2 4/2003 Berckenhoff et al.
6,637,516 B1 10/2003 Boyd
6,651,746 B2 11/2003 Boyd

RAM BOP SHEAR DEVICE

BACKGROUND OF INVENTION

1. Field of the Invention

The invention relates generally to blowout preventers used in the oil and gas industry. Specifically, the invention relates to a blowout preventer with a novel shear load intensifying mechanism.

2. Background Art

Well control is an important aspect of oil and gas exploration. When drilling a well, for example, in oil and gas exploration applications, devices must be put in place to prevent injury to personnel and equipment associated with the drilling activities. One such well control device is known as a blowout preventer ("BOP").

BOP's are generally used to seal a wellbore in the event of a "blowout." For example, drilling wells in oil or gas exploration involves penetrating a variety of subsurface geologic structures, called "formations" or "layers." Each layer generally comprises a specific geologic composition such as, for example, shale, sandstone, limestone, etc. Each layer may contain trapped fluids or gas at different formation pressures, and the formation pressures generally increase with increasing depth. The working pressure of the drilling fluid in the wellbore is generally adjusted to at least balance the formation pressure by, for example, increasing a density of the drilling fluid in the wellbore or increasing pump pressure at the surface of the well.

There are occasions during drilling operations when a wellbore may penetrate a layer having a formation pressure substantially higher that the pressure maintained in the wellbore. When this occurs, the well is said to have "taken a kick." The pressure increase associated with the kick is generally produced by an influx of formation fluids (which may be a liquid, a gas, or a combination thereof) into the wellbore. The relatively high pressure kick tends to propagate from a point of entry in the wellbore uphole (from a high pressure region to a low pressure region). If the kick is allowed to reach the surface, drilling fluid, well tools, and other drilling structures may be blown out of the wellbore. These "blowouts" often result in catastrophic destruction of the drilling equipment (including, for example, the drilling rig) and in substantial injury or death of rig personnel.

Because of the risk of blowouts, BOP's are typically installed at the surface or on the sea floor in deep water drilling arrangements so that kicks may be adequately controlled and "circulated out" of the system. BOP's may be activated to effectively seal in a wellbore until measures can be taken to control the kick. There are several types of BOP's, the most common of which are annular blowout preventers and ram-type blowout preventers.

Annular blowout preventers typically comprise annular elastomer "packers" that may be activated (e.g., inflated) to encapsulate drillpipe and well tools and completely seal the wellbore. A second type of the blowout preventer is the ram-type blowout preventer. Ram-type preventers typically comprise a body and at least two oppositely disposed bonnets.

Interior of each bonnet is a piston actuated ram. The rams may be pipe rams (or variable pipe rams) (which, when activated, move to engage and surround drillpipe and well tools to seal the wellbore), shear rams (which, when activated, move to engage and physically shear any drillpipe or well tools in the wellbore), or blind rams. The rams are typically located opposite of each other and, whether pipe rams or shear rams, the rams typically seal against one another proximate a center of the wellbore in order to completely seal the wellbore.

In some cases, flexible materials that are located within a central bore of a BOP will "snake" around the shearing elements on shear rams. When this occurs, the flexible materials may not be fully sheared by the rams when the BOP is energized and the rams closed. Thus, what is needed is a BOP with ram blocks that will effectively shear both rigid and flexible materials that are located in a central bore of the BOP.

SUMMARY OF INVENTION

In one aspect, the invention relates to a ram-type blowout preventer that includes a body, a first ram block positioned within the body and having a first shearing element and a first sealing element, and a second ram block positioned within the body and opposing the first ram block, the second ram block having a second shearing element and a second sealing element. The blowout preventer may also include a load intensifying member coupled to the first ram block, wherein the first ram block and the second ram block are configured to close together upon activation of the blowout preventer, and wherein the load intensifying member is positioned to engage with the second ram block when the first and second ram block close and force the first shearing element and the second shearing element together.

In another aspect, the invention relates to a method of energizing a blowout preventer that includes moving a first ram block and a second ram block into a closed position, and engaging a load intensifying member coupled to the first ram block with the second ram block to increase the vertical load between a first shearing element on the first ram block and a second shearing element on the second ram block.

In another aspect, the invention relates to a method of energizing a blowout preventer that includes moving a first ram block and a second ram block into a closed position, and engaging a load intensifying member coupled to the first ram block with the second ram block to increase the vertical load between a first shearing element on the first ram block and a second shearing element on the second ram block.

Other aspects and advantages of the invention will be apparent from the following description and the appended claims.

DETAILED DESCRIPTION

Embodiments of the present invention relate to a ram block that includes a load intensifying member coupled to the ram block. Other embodiments may relate to a BOP with a load intensifying member that is coupled to a ram block within the BOP. In this disclosure, particular embodiments of a load intensifying member are disclosed and described as a "pin." This is only one example of such a member, and the invention is not intended to be so limited.

Figure 1:
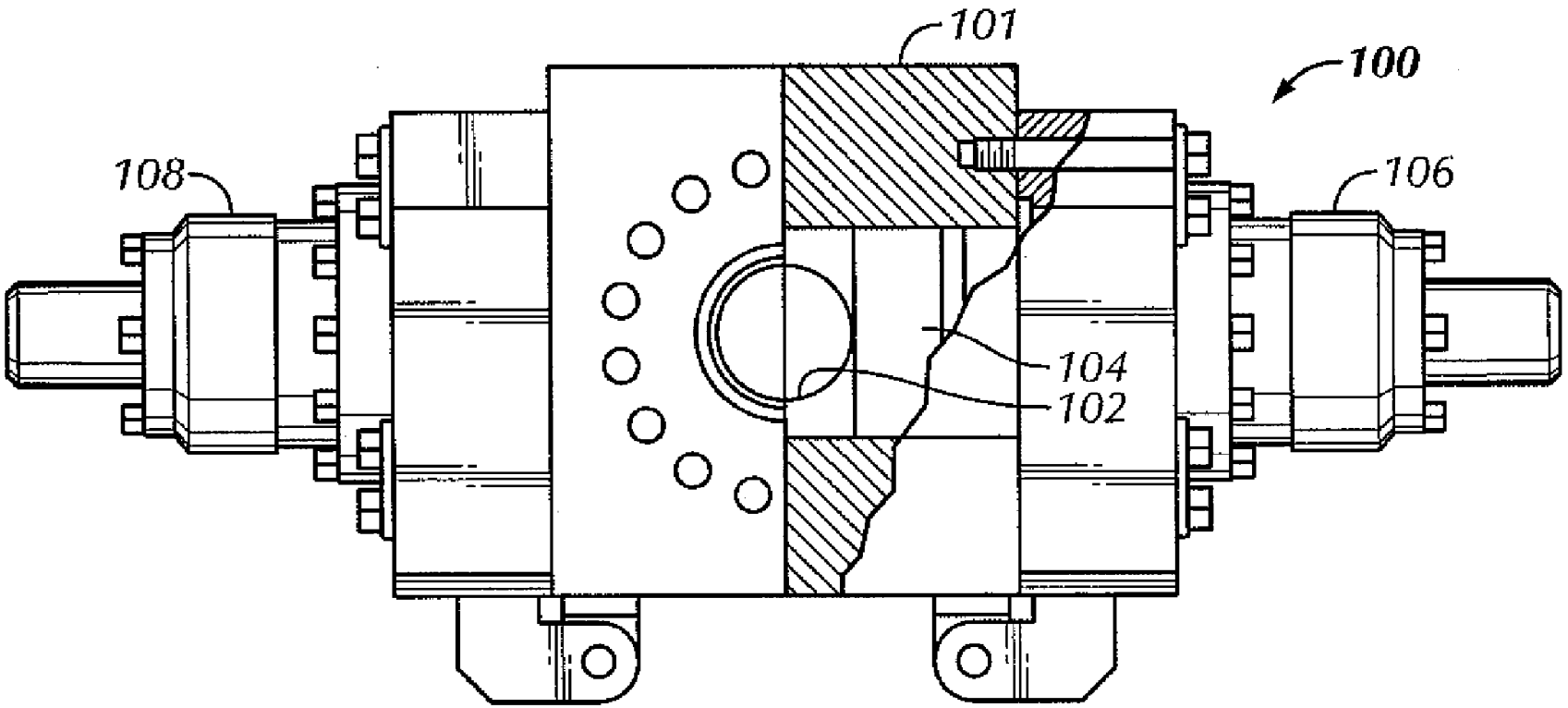
FIG. 1 shows a partial cutaway top view of a ram-type BOP.

FIG. 1 shows a top view cutaway of a typical ram-type blowout preventer 100 ("BOP"). During normal drilling and well operations, the BOP remains open. The drill string (not shown) and other well tools are lowered into the well through the center bore 102 of the BOP 100, which is generally mounted on the top of the well (not shown).

The BOP 100 includes a body 101 and two oppositely positioned bonnets 106, 108. The bonnets 106, 108 house the piston mechanisms that drive the ram blocks to a closed position in the event of a blowout. The BOP 100 includes two ram blocks. Only one ram block 104 is shown in the cutaway of FIG. 1, but it will be understood that the BOP 100 includes at least one other ram block for engaging and sealing with the first ram block 104.

The BOP 100 in FIG. 1 includes shear ram blocks (e.g., ram block 104). When the BOP is actuated, the ram blocks in the BOP are forced together. As the ram blocks converge, shearing elements on the ram blocks shear any materials or tools in the center bore 102 of the BOP 100. Once the material and tools (not shown) in the center bore 102 are sheared, sealing elements on the ram blocks engage to seal the pressure in the wellbore.

Figure 2:
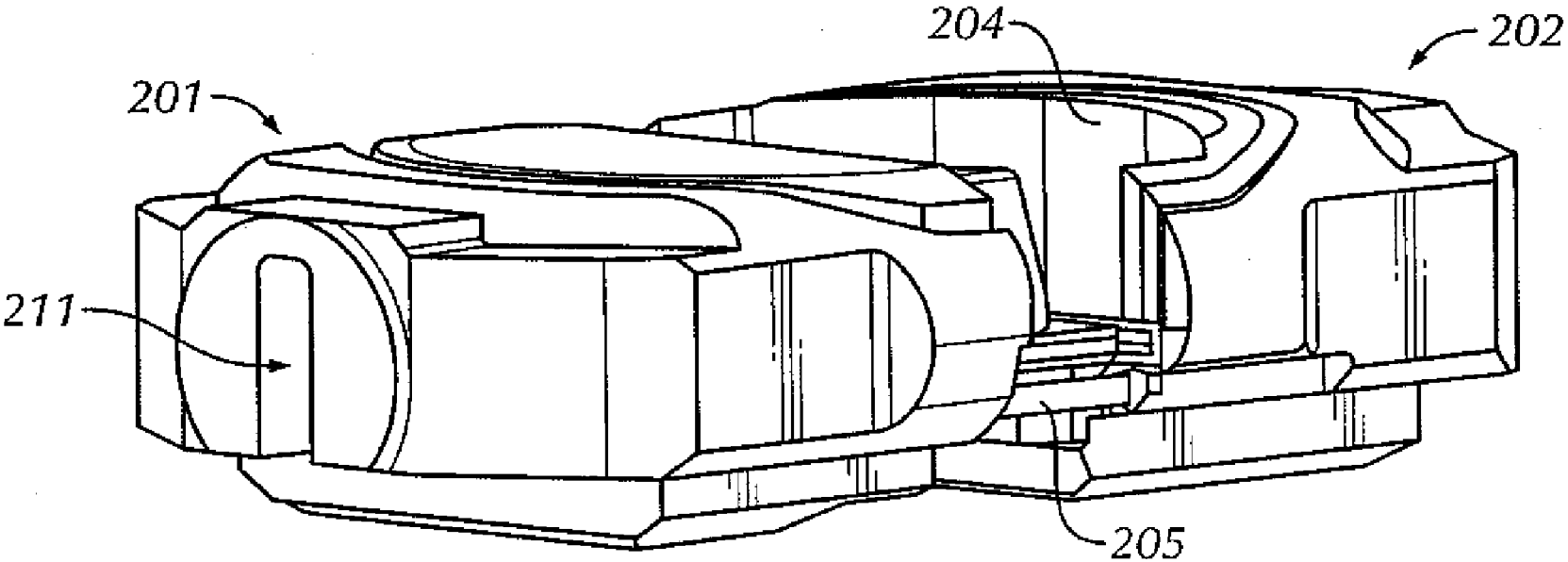
FIG. 2 is a perspective view of two ram blocks in accordance with one embodiment of the invention.

FIG. 2 is a perspective view of two ram blocks 201, 202 that may form part of a BOP (e.g., BOP 100 in FIG. 1) in accordance with the invention. The ram blocks 201, 202 are shown separate from a BOP for ease of understanding. The first ram block 201 includes a connector 211 where the ram block 201 may be connected to a driving rod or piston (not shown) or other device for forcing the ram block 201 into a closed position. A similar connector (not shown) may be present on the second ram block 202.

As will be explained with reference to FIG. 3, the second ram block 202 includes a sealing element 204 that mates with a sealing element (not shown) on the first ram block 201, when the ram blocks 201, 202 are engaged and the BOP is in a closed position.

The first ram block 201 includes a load intensifying member. In FIG. 2, the load intensifying member is a pin 205, although the invention is not so limited. The load intensifying pin 205 is coupled to the first ram block 201 so that it will engage with the second ram block 202 when the ram blocks 201, 202 are moved together as the BOP is energized.

Figure 3:
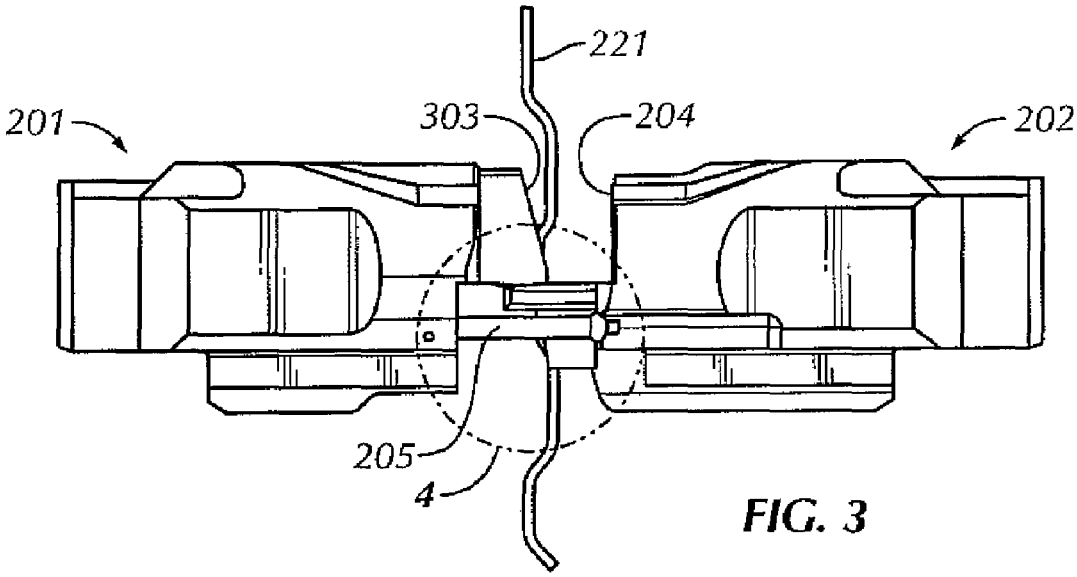
FIG. 3 is a side view drawing of two ram blocks in accordance with one embodiment of the invention.

FIG. 3 shows a cross section of the ram blocks 201, 202 of a BOP (not shown) as the ram blocks 201, 202 are moved toward a closed or engaged position. The first ram block 201 includes a sealing surface 303 that engages with a sealing surface 204 of the second ram block 202 when the ram blocks 201, 202 are engaged in a closed position. The sealing surfaces 303, 204 mate to seal the pressure in the wellbore (generally below the ram blocks).

Figure 4:
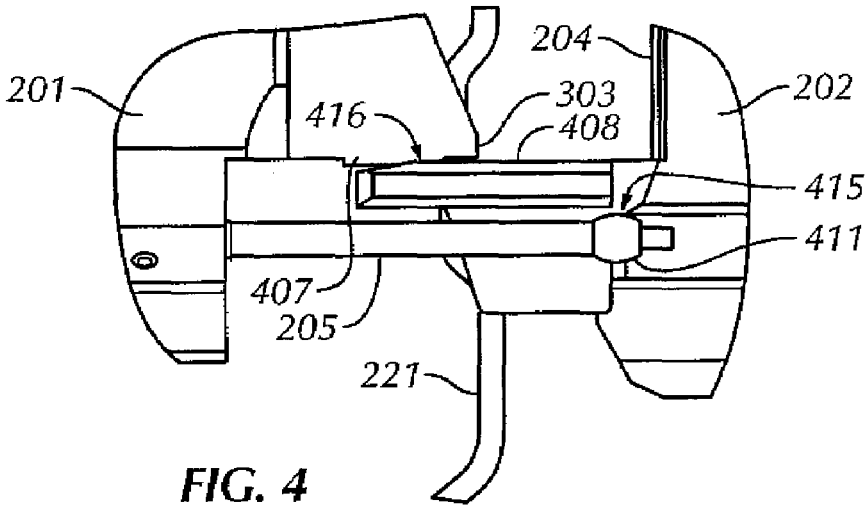
FIG. 4 is an enlargement of a section of the view shown in FIG. 3.

FIG. 4 shows an enlargement of the circled section of FIG. 3. In FIG. 4, the second ram block 202 includes a shearing element 408. The shearing element 408 on the second ram block 202 operates cooperatively with a shearing element 407 on the first ram block 201 to shear any equipment or well tools that are positioned in the central bore of the BOP (e.g., central bore 102 in FIG. 1). As the shearing elements 407, 408 come together, they cut through, or shear, any materials or equipment in the central bore of the BOP.

As shown in FIG. 4, in some embodiments of ram blocks, the shear element 408 on the second ram block 202 slides under the shear element 407 on the first ram block 201. Ideally, there will be vertical pressure between the shear elements 407, 408 when the ram blocks 201, 202 are in a closed position. In some cases, however, when a flexible material is located in the central bore of the BOP, the shear may be incomplete. For example, when a wire or cable, such as wire 221 shown in FIGS. 3 and 4, is present in the central bore, the wire 221 may snake around the shearing element 407, 408, and the shear of the wire 221 will be incomplete. In such cases, the wire 221, as it snakes around the shear elements 407, 408, will push the shear elements 407, 408 apart and occupy the space in between.

In the event of an incomplete shear of material in the central bore of a BOP, the material cannot be moved from between the sealing elements (e.g., sealing elements 204, 303 in FIG. 3) of the opposing ram blocks. Thus, only an incomplete seal may be formed between the ram block. This represents a potential danger in the event of a blowout.

A load intensifying pin 205, according to certain embodiments of the invention, may enable a proper shear of flexible materials, such as a wire 221. In FIG. 4, The load intensifying pin 205 is coupled to the first ram block 201 so that it will engage with the second ram block 202 when the ram blocks 201, 202 are moved into a closed position. In the embodiment shown in FIG. 4, the load intensifying pin 205 engages with the second ram block 202 at an engagement surface 415. The engagement of the load intensifying pin 205 and the second ram block 202 creates a downward force on the load intensifying pin 205, and thus also on the first ram block 201, and it creates a corresponding upward force on the second ram block 202. The forces push the shear element 408 of the second ram block 202 and the shear element 407 of the first ram block 201 together. The load intensifying pin 205 "intensifies" the load between the shear elements 407, 408.

It is noted that other embodiments may include a load intensifying pin that engages with an opposing ram block to create an upward force on the pin and a downward force on the opposing ram block. The particular direction of the force is not intended to limit the invention.

The load intensifying member 205 prevents vertical separation between the shear elements 407, 408. In fact, in certain embodiments, a load intensifying member 205 will increase the load between the shear elements 407, 408. This creates a "scissor effect" that will effectively shear even flexible materials that are positioned in the central bore of the BOP.

In some embodiments, the load intensifying member 205 includes a bulbous head 411. The shape of the head 411 enables the load intensifying pin 205 to continuously increase the load between the shear elements 407, 408 as the ram blocks 201, 202 come together. In some embodiments, the engagement surface 415 on the second ram block 202 comprises a sloped surface that will push the load intensifying pin 205 downwardly, which will also continuously increase the load between the shear elements 407, 408 as the ram blocks 201, 202 move to a closed position.

Figure 5:
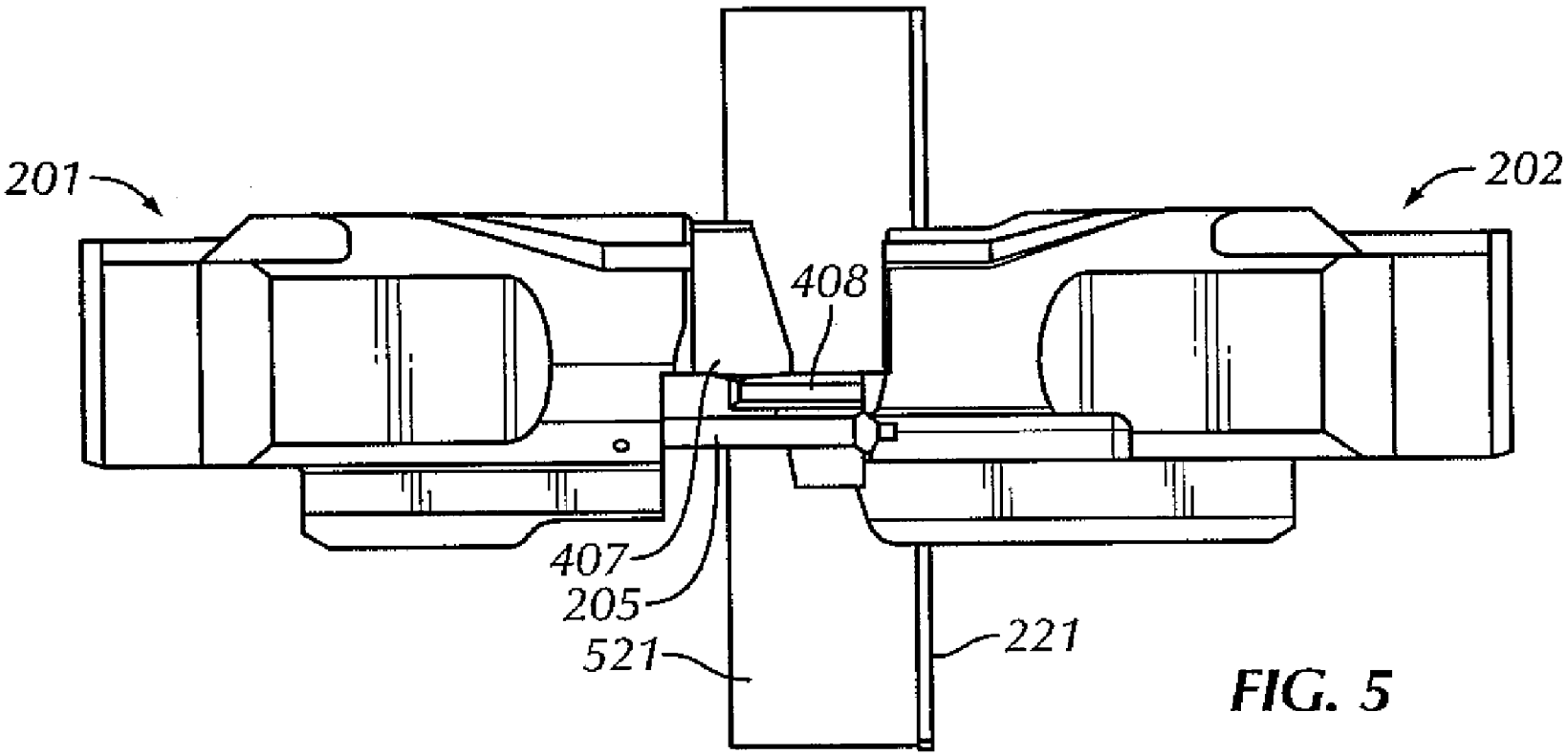
FIG. 5 is a side view drawing of two ram blocks in accordance with one embodiment of the invention.

FIG. 5 shows an embodiment of ram blocks 201, 202 with a pipe 521 (e.g., a drill pipe used to rotate a drill bit during drilling) running through the central bore of a BOP (not shown). In addition, a wire 221 is also running through the central bore of the BOP. The load intensifying pin 205 is positioned so that it will not engage with the second ram block 202 until after the shearing elements 407, 408 have sheared the pipe 521 running through the center bore of the BOP (not shown). As shown in FIG. 5, the load intensifying pin 205 does not engage with the second ram block 202 until there is at least some vertical overlap between the shear elements 407, 408. Thus, rigid objects in the central bore of the BOP may be completely sheared before the load intensifying pin 205 engages the second ram block 202.

Thus, in certain embodiments of the invention, a load intensifying member or pin has a length that is selected so that it will not engage with an opposing ram block until after there is vertical overlap between shear elements. In other embodiments, a load intensifying pin has a length selected so that it will not engage with an opposing ram block until after there is contact between the shearing elements on the opposing ram blocks.

Figure 6:
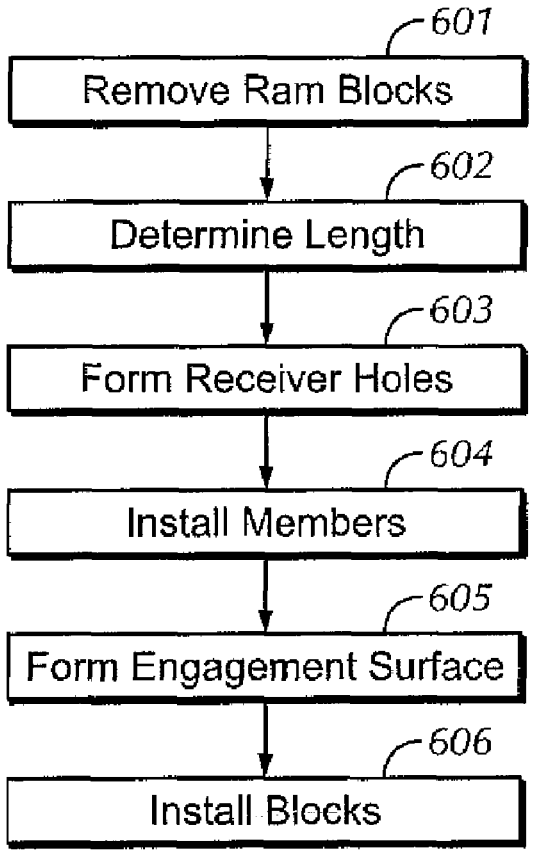
FIG. 6 shows a method in accordance with one embodiment of the invention.

FIG. 6 shows an embodiment of a method in accordance with the invention. A method for re-fitting the ram blocks of an existing BOP may include removing the ram blocks from the BOP, at step 601. In some cases, the ram blocks may be removed by others and transported to a re-fitting facility. Thus, the step of removing the ram blocks is not required by all embodiments of the invention.

In addition, some BOP designs enable access to the ram blocks, without having to remove the ram blocks from the BOP. For example, one such BOP is disclosed in U.S. Pat. No. 6,554,247, assigned to the assignee of the present invention, and incorporated by reference herein. In such cases, the ram blocks may be modified without removing the ram blocks from the BOP.

Next, the method may include determining the desired length for one or more load intensifying members to be installed in the existing BOP, at step 602. Is some embodiments, the desired length corresponds to a length that will enable the shearing of non-flexible items, such as a pipe, in the central bore of the BOP before the load intensifying pins engage the opposing ram block.

Next, the method may include forming one or more receiver holes in a ram block, at step 603. The receiver holes receive the load intensifying members that are being installed on the ram blocks of an existing BOP. Such receiver holes must be formed in a position so that the load intensifying members, when installed, will properly engage an opposing ram block.

Next, the method may include installing one or more load intensifying members in a ram block, at step 604. The load intensifying members may be coupled to a ram block in any manner known in the art. In addition, the load intensifying members may comprise pins. For example, load intensifying pins may be installed in receiver holes that have been formed in the ram block (such as in step 603, if included). The load intensifying pins may be installed on a ram block so that they force a shearing element on the ram block together with a second shearing element on an opposing ram block. In some embodiments, two or more load intensifying pins may be installed on a ram block. In at least one embodiment, one load intensifying pin is installed on one ram block, and a second load intensifying pin is installed on an opposing ram block. The pins operate cooperatively to increase the load between the shearing elements and create a scissor effect.

Next, the method may include forming one or more engagement surfaces on an opposing ram block, at step 605. A engagement surface is positioned to engage with a load intensifying pin when the ram blocks are moved to a closed position. In some embodiments, the engagement surfaces are formed at a slope so that the load between the hearing elements will increase as the ram blocks move closer together.

Finally, the method may include installing the ram blocks into a BOP, at step 606. The ram blocks may be installed in the BOP from which they were removed, or, in some cases, the ram blocks may be installed in another suitable BOP.

It is noted that ram blocks are generally interchangeable parts for a BOP. That is, the ram blocks may be removed and replaced on an existing BOP at regular intervals. In addition, one particular type of ram block may be adapted to fit into more than one BOP. For example, it is common to install multiple BOP's in a BOP stack. By using similar BOP's, it enables a ram block to be used in more than one BOP. Accordingly, the method of refitting an existing ram block should not be construed to exclude a ram block that is stored as a "spare," even though such a ram block was not removed from an existing BOP.

Certain embodiments of the invention may present one or more of the following advantages. A BOP with at least one load intensifying pin may more effectively shear flexible materials that are positioned in the central bore of the BOP. Advantageously, certain embodiments may enable the shearing of rigid materials before a load intensifying pin engages an opposing ram bock. This will enable a BOP to shear rigid materials without the added friction and force that is created by a load intensifying pin. In such embodiments, the increase in friction and closing force is experienced after any rigid materials have been successfully sheared.

Figure 7:
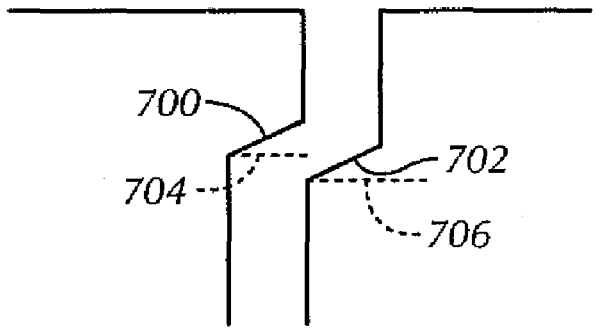
FIG. 7 shows an apparatus in accordance with an embodiment of the invention.

FIG. 7 shows a cross-section of a first ram block and a second ram block in accordance with an embodiment of the invention, wherein the load intensifying member serves as a mechanism for establishing vertical load to assist in sealing the BOP (in addition to or instead of the shearing function discussed above). In this embodiment, vertically opposed first engagement surface 700 disposed on a first ram bock and second engagement surface 702 disposed on a second ram block (which are shown as sloped, but may also be horizontal (shown as 704 and 706)) form a sealing surface when engaged by the load intensifying member, upon actuation of the blowout preventer. Those having ordinary skill in the art will appreciate that the vertical load added by the load intensifying member may cause a metal-to-metal seal to form between the first engagement surface 700 and the second engagement surface 702. In this embodiment, therefore, the load intensifying member serves to assist in the sealing aspect of a BOP.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A ram-type blowout preventer, comprising:

a body;

a first ram block positioned within the body and having a first shearing element and a first sealing element;

a second ram block positioned within the body and opposing the first ram block, the second ram block having a second shearing element and a second sealing element; and a load intensifying member coupled to the first ram block, wherein the first ram block and the second ram block are configured to close together upon actuation of the blowout preventer, and wherein the load intensifying member is positioned to engage with a member engagement surface of the second ram block when the first and second ram block close and force the first shearing element and the second shearing element together, wherein the member engagement surface is sloped so that a force between the first and second shearing elements is increased as the first and the second ram blocks move toward a closed position.

2. The ram-type blowout preventer of claim 1, wherein the load intensifying member is a pin.

3. The ram-type blowout preventer of claim 2, wherein the pin comprises a bulbous head.

4. The ram-type blowout preventer of claim 1, wherein the load intensifying member has a selected length so that it will engage with the second ram block after at least a partial vertical overlap between the first and second shearing elements.

5. The ram-type blowout preventer of claim 1, further comprising a second load intensifying member coupled to the first ram block, and positioned engage with The second ram block when the first and second ram blocks close, the engagement between the second load intensifying member and The second ram block forcing The first shearing element and the second shearing element together.

6. A method of retrofitting a ram block, comprising:

coupling a load intensifying member to the ram block so that the load intensifying member will engage a sloped member engagement surface of a second ram block when the ram blocks are moved to a closed position, such engagement continually increasing a force between a first shear element of the first ram block and a second shear element on The second ram block as the first and the second ram blocks move toward a closed position.

7. The method of claim 6, further comprising forming a member retention hole in the ram block.

8. The method of claim 6, further comprising accessing the ram block in a blowout preventer.

9. The method of claim 6, further comprising removing the ram block from a blowout preventer.

10. The method of claim 6, further comprising installing the ram block in a blowout preventer.

11. The method of claim 6, further comprising coupling a second load intensifying member to the ram block so that the second load intensifying member will engage a second sloped member engagement surface of the second ram block when the ram blocks are moved to the closed position, such engagement increasing the force between the first and second shear elements as the first and the second ram blocks move toward a closed position.

12. A method of energizing a blowout preventer, comprising:

moving a first ram block and a second ram block into a closed position; and engaging a load intensifying member coupled to the first ram block with a sloped member engagement surface of the second ram block to continually increase a vertical load between a first shearing clement on the first ram block and a second shearing element on the second ram block as the first and second ram blocks move toward a closed position.

13. A method of energizing a blowout preventer, comprising:

moving a first ram block and a second ram block into a closed position; and engaging a load intensifying member coupled to the first ram block with a sloped member engagement surface of the second ram block to continually increase a vertical load between a first engagement surface on the first ram block and a second engagement surface on the second ram block as the first and the second ram blocks move toward a closed position.

* * * * *